US005657994A

United States Patent [19]

O'Connor

[11] Patent Number: 5,657,994

[45] Date of Patent: Aug. 19, 1997

[54] WORD-GAME

[76] Inventor: Paul Cornelius John O'Connor, 20 Renfew Place, Guelph, Ontario, Canada, N1G 2Z5

[21] Appl. No.: 570,523

[22] Filed: Dec. 11, 1995

[30] Foreign Application Priority Data

Dec. 19, 1994 [CA] Canada ..... 2138440

[51] Int. Cl.[6] ..... A63F 9/18

[52] U.S. Cl. ..... 273/299; 273/272; 434/167

[58] Field of Search ..... 273/272, 299, 273/300, 302, 153 R, 429, 430, 431, 432; 434/156, 167, 168, 169, 171, 172

[56] References Cited

U.S. PATENT DOCUMENTS

| | | | |
|---|---|---|---|
| 1,280,930 | 10/1918 | Wolfe . | |
| 2,128,749 | 10/1938 | Koch et al. | 273/135 |
| 2,995,374 | 8/1961 | Deatherage | 273/134 |
| 3,016,243 | 1/1962 | Irwin | 273/135 |
| 3,798,797 | 3/1974 | Mandel | 35/35 |
| 3,805,416 | 4/1974 | Plefkey | 35/35 D |
| 4,084,816 | 4/1978 | Shafer | 273/1 R |
| 4,204,343 | 5/1980 | Brooks | 35/73 |
| 4,219,197 | 8/1980 | Acuff | 273/299 |
| 4,666,163 | 5/1987 | Hirschfeld | 273/293 |
| 4,944,519 | 7/1990 | Canela | 273/243 |
| 5,014,996 | 5/1991 | von Brauhut | 273/299 |
| 5,108,113 | 4/1992 | Leach | 273/302 |
| 5,195,753 | 3/1993 | Brukl et al. | 273/429 |
| 5,207,435 | 5/1993 | Tanner | 273/429 |

OTHER PUBLICATIONS

"The Puzzle Mountain," Brandreth, G, (New York: Morrow and Company Inc) 1981, pp. 11, 106, 107, 113, 114.

*Primary Examiner*—William M. Pierce

*Attorney, Agent, or Firm*—Anthony Asquith & Co.

[57] ABSTRACT

The game apparatus comprises a pack of cards, each having printed thereon a respective pictogram. The pictogram carries two letters and two blank markers indicating wild letters. The pictogram is repeated four times on the card, one on each side of the rectangular card. The players form words according to the pictogram. The apparatus also includes a number spinner, for indicating the number of letters in the words the players have to form; and includes a strike-bell whereby a player can indicate that he has thought of a suitable word. The cards are marked with difficulty stripes, indicating the number of words from a dictionary list that fit the particular pictogram.

10 Claims, 2 Drawing Sheets

WORD-GAME

This invention relates to a game apparatus including a pack of cards, in which the players attempt to form suitable words based on the cards.

BACKGROUND TO THE INVENTION

There have been many word-forming games, in which cards have letters printed thereon, and the players try to make up words by using the cards at their disposal in various combinations. Generally, the conventional games have been based on players trying to collect a series of cards depicting letters, or parts of words. The winner is the player who assembles all the cards required to form particular words.

Generally, also, in the conventional games the players have taken it in turns to try to improve their letter-cards.

The invention provides a game apparatus which permits the word-forming game to be played simultaneously by all the players; that is to say, the players compete directly with each other as to who can be the first to form a word.

GENERAL FEATURES OF THE INVENTION

The invention provides a pack of cards. Each card is marked on its face with a set of pictograms. The pictogram includes characters, being two letters of the alphabet, printed on the card, and at least one wild-letter symbol (and preferably two such symbols) indicating a player-selected letter. The characters appear in the pictogram in left-to-right reading sequence.

In play of the game, the players make up a word which takes the said two letters of the pictogram, and takes wild letters corresponding in position to the position of the symbol.

The pictogram is printed clearly on the face of the card, such that the characters in the pictogram are immediately and clearly readable by the players upon the card being turned face-up. The pictogram is repeated on the face of the card; the card being rectangular, the repeats are preferably four in number, and placed on the four sides of the card. Thus the pictogram is immediately presented to players viewing the card from any position around the playing table.

The four repeats of the pictogram on any one card are all identical, but the pictograms are different card to card. In fact, it is not ruled out that some pairs of cards may have the same pictogram. In any case, preferably the number of cards in the pack should be such that players cannot remember particular pictograms.

THE INVENTION IN RELATION TO THE PRIOR ART

Patent publication number U.S. Pat. No. 2,995,374 (Deatherage, 1961) shows a game apparatus wherein a game board is printed with sets of characters including letters and symbols indicating wild letters in reading sequence, and wherein the sets of characters are oriented to the four sides of a rectangle. However, the game is not suitable to enable the game to be played simultaneously by all the players.

Patent publication number U.S. Pat. No. 5,014,996 (vonBraunhut, 1991) shows a pack of cards in which letters are visible with the card either way up, like a regular playing card. Again, however, the game is not suitable to enable the game to be played simultaneously by all the players.

DETAILED DESCRIPTION OF PREFERRED EMBODIMENT

By way of further explanation of the invention, an exemplary embodiment of the invention will now be described with reference to the accompanying drawings, in which:

The apparatus shown in the accompanying drawings and described below is an example which embodies the invention. It should be noted that the scope of the invention is defined by the accompanying claims, and not necessarily by specific features of exemplary embodiments.

Figure 1:
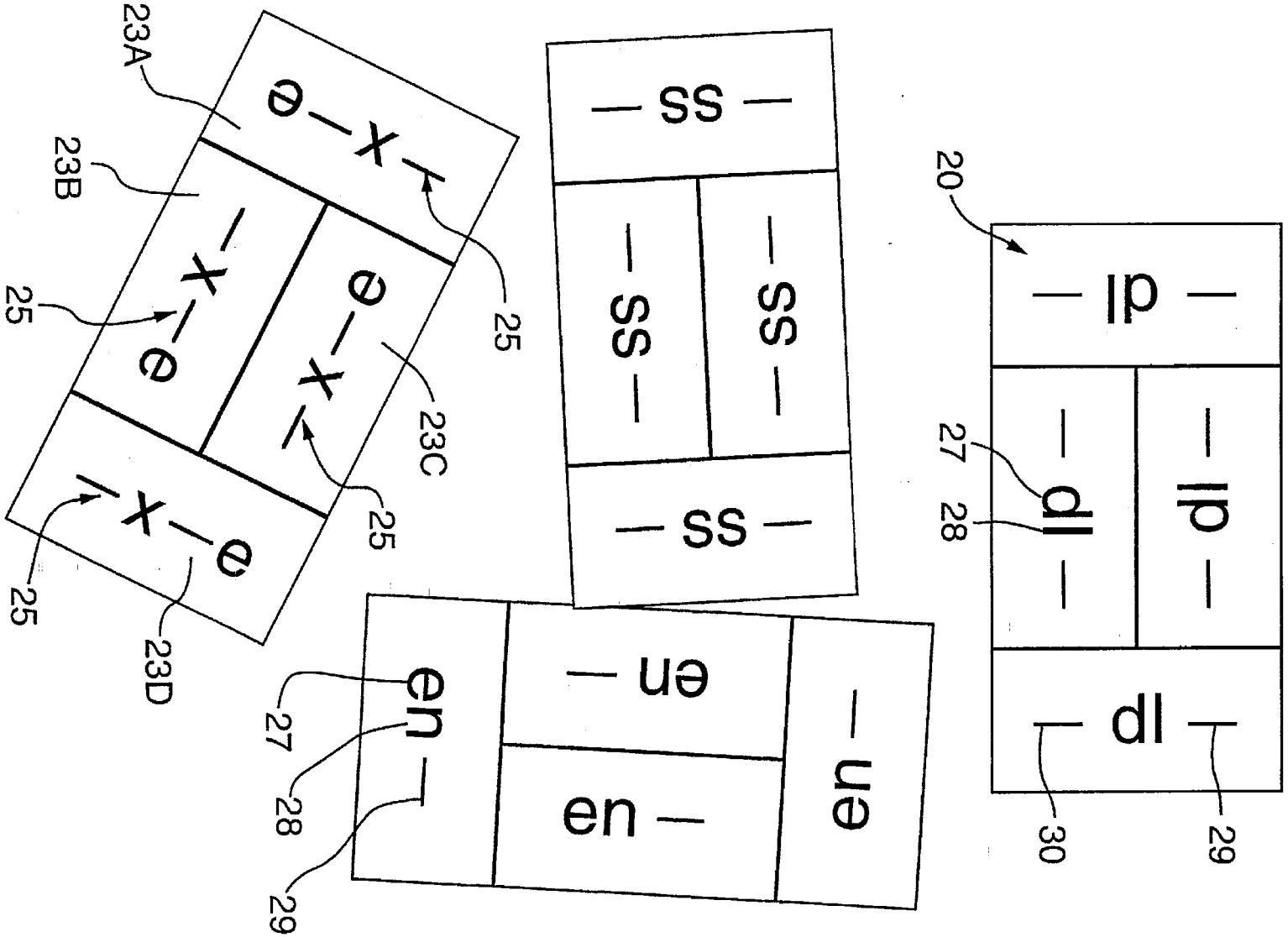
FIG. 1 is an illustration of game apparatus which embodies the invention, being cards from a pack of cards, each of which has printed thereon a pictogram.

As shown in FIG. 1, a card 20 is rectangular, and is made of conventional cardboard, plastic, or other suitable material.

The card 20 is marked out in four equal-area portions, 23A,23B,23C,23D. Each of the portions is printed with a pictogram 25, and all four of the pictograms on any one of the cards are identical. That is to say, the pictogram 25 is repeated four times on each card 20.

When the card 20 is placed face-up on a table, the pictogram 25 is visible from all sides around the table. Not only is the pictogram visible, it is very clearly and instantly visible, as soon as the card is upturned, and no matter from what orientation the card is viewed.

In the game, the cards 20 are turned face-up, in sequence, and the players then try to make up words appropriate to the pictogram 25 in a first-to-form-a-word-wins manner; therefore, the fact that the pictogram is instantly and clearly visible from all sides is important to the manner in which the game is played. If the pictogram were not so visible in a particular orientation, one player might be at an unfair advantage if the pictogram were more readily visible from his direction.

Each pictogram 25 comprises (in the preferred, as illustrated, version) two letters 27,28 and one or two wild-letter symbols or blank markers 29,30. It is possible to arrange two letters and one or two blank markers in several different arrangements; and it is contemplated that all of the possible arrangements may be used. For example, the two letters a,b may appear as -ab, -a-b, -ab-, a-b-, a-b, and ab-, in different pictograms. Each of the cards 20 is printed with a different pictogram.

The basic idea of the game is that the players seek to form a word which uses the two letters 27,28 in the positions indicated in the pictogram, and uses wild letters (i.e. letters selected by choice of the player) in the places indicated by the blank markers 29,30.

When a player has thought of a word that he thinks fills the requirement of the card, he indicates to the other players that he has a solution. The player then offers his word to the other players for adjudication, and if the word is approved, he scores points.

The rules of play may be such that, at this time, other players who have thought of (different) words may offer those also for adjudication, and if approved, such players may also score points.

Figure 2:
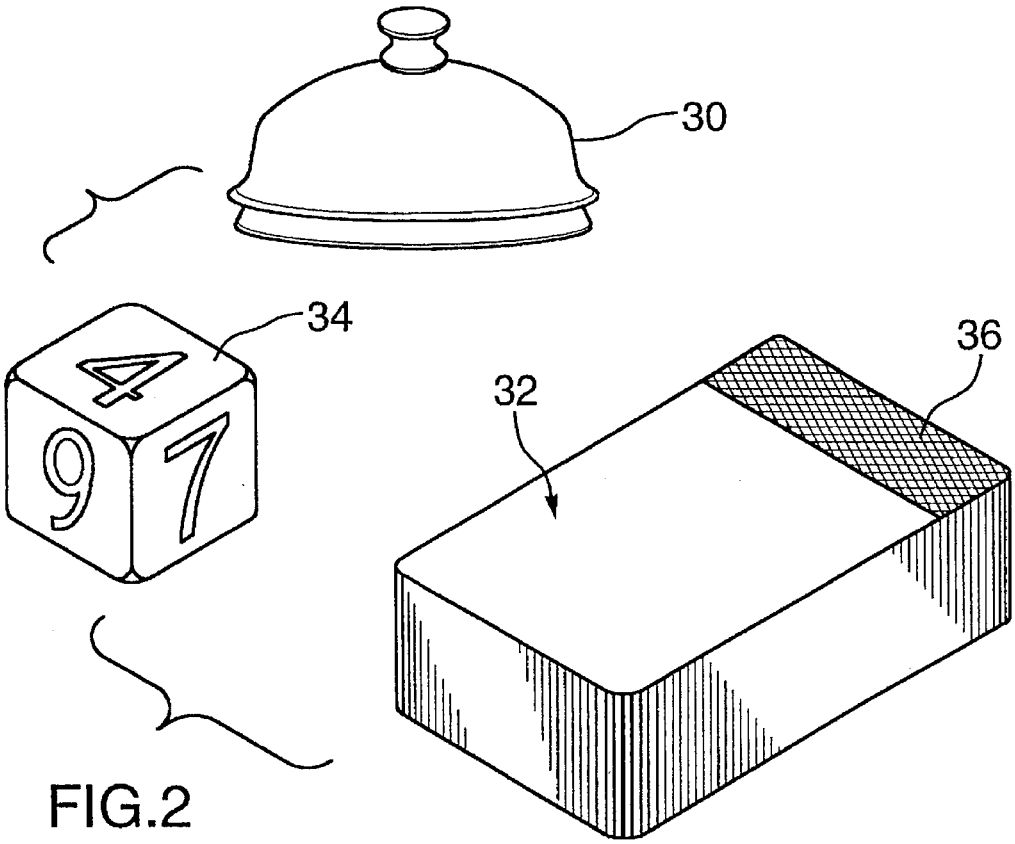
FIG. 2 is an illustration showing other items of the game apparatus.

A player may indicate that he is ready to offer a word by means of striking a bell 30 (FIG. 2), for example. The bell, or other suitable indicator, would be included with the pack 32 of cards 20 as a component of the game apparatus. The invention is not limited to a strike-bell; but the type of indicator should be such that the indicator is equally accessible to all the players.

The number of letters in the word should be at least four. However, more letters may be acceptable. For example, the word "acceptable" is acceptable to fill -ab-, but not to fill -a-b, where the word has to end with "b".

The game may be played using a number generator, for example a random number generator such as a die or spinner 34. In play, the number is generated prior to the next card being upturned. If the number is, say, seven, the players are limited to (at least) that number of letters in their solutions, and the letters must be in the positions as indicated. Thus, cabbage is an acceptable solution to -ab-, seven. So are inhabit and lullaby; but ability and placebo are not.

Rules can be written to specify arbitrarily whether place names, (e.g. Babylon) will be accepted. Also, whether such contrived words as megabit will be accepted should be decided upon beforehand.

It should also be agreed upon as to whether the number indicated by the number generator is to serve only as a minimum, or as both minimum and maximum. If the number serves only as a minimum, then universalizability, for example, can be accepted as a solution to -ab-, five.

It may be arranged that extra points are scored if the player's word has more letters, being letters in addition to the minimum number specified by the number generated.

The rules may specify that whether or not a word is acceptable depends on whether the word appears in a particular dictionary, or any dictionary, or is listed on a particular, or on any, computer spell-checker program.

When playing the game, the pack 32 of cards 20 is placed face-down on the table, i.e. with the pictograms 25 printed on the card hidden. The number generator 34 is then caused to issue a number, which will signify the minimum number of letters.

When all the players are ready, the topmost card 20 on the pack 32 is upturned. When the player who was first-to-the-bell has had his word scored, the player who was second-to-the-bell may also present his word for scoring. It may be arranged that the available points for second-to-the-bell are on a reduced scale.

The variations on scoring, etc, as described, are options that may be applied to the basic game. However, a key point of the basic game, whatever the variations in scoring, is that the upturned card is presented to all the players simultaneously, and immediately the card is upturned.

In the game as described, the players do not take turns, in sequence, to try to form a word. All the players compete together, at the same time, and compete to be the first to indicate that they have formed a word. Therefore, it is important that the pictogram 25 be instantly and unmistakably readable from all angles, as soon as the card 20 is turned over. Although the players may be scored in sequence, i.e. depending on the order in which they reached the bell, the point is that the players all compete together, and all compete on the same pictogram.

The rules may be written to specify that a second player cannot simply add a suffix or prefix onto the word formed by the first player. For example, if the first player's word is lovable it would spoil the game if the second player were permitted to have simply lovably. The rules may specify that the second word must have its own distinct root; this could be codified in that the second word must not be a variation appearing under the same root-word in the dictionary.

As an added refinement, some of the pictograms may be designated as more difficult than others. The levels of difficulty may be specified subjectively, but it is preferred that the levels of difficulty be based on an actual count of available words. For example, there are many hundreds of words which fit the pictogram pattern -ab- whereas there are only ten or so which fit -a-b. Similarly, -f-g fits dozens of words, whereas -g-f fits none. The pictogram may be classed as "easy" if there are more than about, say, forty words that fit the pictogram; "average" if there are between thirty and forty words, and "difficult" if there are between twenty and thirty words. The designer of the game may vary the category of a pictogram in the case where the pictogram "looks" difficult, but actually is not: for example, -x-t looks very difficult, but actually covers dozens of acceptable words.

It may be decided that any pictogram which has fewer than twenty words should not be included in the game. The list of acceptable words may be taken from an agreed-upon, or specified, dictionary or other word listing. The assessments are easier to compute if the word list is on computer.

It should be borne in mind that the minimum number of letters in the word is directed by the number generator 34. Therefore, when computing the list of acceptable words, the frequency should be noted of words having the different numbers of letters. If a particular pictogram has several long words, but only a few short words, that would be acceptable, assuming the number of letters from the generator is to serve only as a minimum, not as a maximum as well; but a combination that has many short words and few long words would not be so acceptable, because then there will be too much difficulty in a case where the number of letters is high.

In this regard, it may be noted that it is quite simple for the designer of the game to provide pictograms that have no words at all, or pictograms that have only one or two acceptable words. For example, there is only one dictionary word that ends in --v, i.e. Slav, and that is only marginally acceptable for use in the game. It is felt that the game played at that level would not find favor with the general public.

It is contemplated that the designer might include such pictograms, particularly if the game is intended for a special group of players, but it is felt that it would spoil the normal game if the pictograms, or some of the pictograms, have fewer than about twenty words that will fit.

Another point that may be noted is that if the pictograms only have a small number of words, it would be possible for a person who is seeking to impress the other players, and who is prepared to spend time beforehand memorizing acceptable words, would have an advantage. But it would be of little advantage to pre-memorize acceptable words if at least twenty words fit the pictogram in any event.

The designer's intention should be to select pictograms that are neither so difficult that the players lose interest trying to think of that one acceptable word, nor yet so easy that whole strings of words immediately occur to all the players.

The game would be spoilt if the pictograms were outside this range, especially if they were too difficult (i.e. if fewer than twenty words fit the pictogram). And, as mentioned, the pictograms can be ordered in level of difficulty, according to the number of words that fit each pictogram.

The level of difficulty of a pictogram may be indicated on the card, for example by means of a coloured stripe 36. The different difficulty levels would be indicated by different colours. Preferably, the difficulty-stripe 36 should be printed on the reverse or back of the card 20, whereby the level of difficulty is visible and indicated to the players before the card is upturned.

The list from which the letter-word frequencies are drawn, for computing the difficulty level, preferably is an identifiable standard list, such as that of the Websters English Dictionary, or the computer spell-check program of a word-processor such as WordPerfect.

The number of cards in the pack can be important. If there were too few cards in the pack, it might occur to a player to try to memorize acceptable words for each pictogram. But if the pack includes hundreds of cards, it would not occur to anyone to attempt this. A preferred number of cards in the pack is three hundred, or more.

The mix of difficulty levels also can be important. A preferred proportion is 55% easy, 30% average, and 15% difficult. This allows players of all word-ability skills to take part meaningfully in the game, and yet allows the more word-able player gradually to forge ahead.

The game apparatus may also include score-sheets, suitable for recording the name of the player who was first to form an acceptable word, number of letters, difficulty level, etc.

The number generator may include the possibility for generating a symbol indicative of a players-choice number, whereby the player operating the generator gets to choose the number.

I claim:

1. Game apparatus for playing a word-forming game, wherein:

the apparatus includes a pack of playing cards;

each playing card has a respective face, and the face is marked with a respective plurality of pictograms thereon;

with respect to each pictogram in the plurality:

the pictogram comprises at least three characters, arranged as a series of the characters in left-to-right reading sequence;

at least two of the said characters in the pictogram comprise letters of the alphabet, and at least one of the characters comprises a symbol indicative of a wild or player-selectable letter;

the pictograms comprising the said plurality of pictograms on the card are identical, in the sense of comprising the same letters and symbol in the same order;

the identical pictograms in the plurality of pictograms on the face of the card are enough in number that, and are arranged in such orientations on the face of the card that, the plurality comprises a means for rendering the letters of at least one of the pictograms in the plurality substantially upright and in a visibly readable orientation when viewed from any point around a table when the card is placed face up on the table;

and each card in the pack has a respective plurality of identical pictograms thereon, that are different from the pictograms on other cards in the pack, the pictograms being different in the sense of comprising different letters;

and the apparatus includes a means for generating a number.

2. Apparatus of claim 1, wherein:

the number of identical pictograms on the card is four;

the pictogram is rectangular in outline;

the card is rectangular;

the four pictograms are disposed on the face of the card such that the lengths of two of the pictograms are disposed lengthways across the width of the card;

the pictogram includes four printed characters, being two letters of the alphabet and two of the said symbols;

the apparatus includes a manually operable indicator, which comprises a means for indicating, when manually operated, that the indicator has been operated.

3. Apparatus of claim 1, wherein the number of identical pictograms on the card is four.

4. Apparatus of claim 1, wherein the pictogram includes four printed characters, being two letters of the alphabet and two of the said symbols.

5. Apparatus of claim 1, wherein the apparatus includes an indicator, and a means for indicating that the indicator has been operated.

6. Apparatus of claim 1, wherein the cards include respective difficulty-signifying-marker-means.

7. Apparatus of claim 6, wherein the difficulty-signifying-marker-means are provided on the backs of the cards, whereby when the cards in the pack are face-down, the difficulty-signifying-marker-means of the topmost card is visible before the card is upturned.

8. Apparatus of claim 6, wherein the markers indicate three levels of difficulty of the pictograms.

9. Apparatus of claim 2, wherein:

the cards include respective difficulty-signifying-markers, indicative of the number of dictionary words that fit the requirements of the particular pictograms of the cards;

the markers are provided on the backs of the cards, whereby when the cards in the pack are face-down, the marker of the topmost card is visible before the card is upturned;

the markers signify difficulty levels, in that the markers indicate, and are responsive to, the result of a computation, being a computation of the number of dictionary words which fill the requirements of the letters and wild letters as signified by the pictogram of that card, and in that the markers indicate whether the number so computed is more or less than a predetermined number.

10. Apparatus of claim 1, wherein the number of cards in the pack is at least three hundred.

* * * * *